US012065831B2

(12) United States Patent
Latterell et al.

(10) Patent No.: US 12,065,831 B2
(45) Date of Patent: Aug. 20, 2024

(54) DECK PLATFORM HANGER

(71) Applicant: Elytron Construction Services, MN S-Corp, Robbinsdale, MN (US)

(72) Inventors: Ronald Gene Latterell, Robbinsdale, MN (US); Duane G. Plumski, Sartell, MN (US)

(73) Assignee: Elytron Construction Services, MN S-Corp, Robbinsdale, MN (US)

( * ) Notice: Subject to any disclaimer, the term of this patent is extended or adjusted under 35 U.S.C. 154(b) by 54 days.

(21) Appl. No.: 17/523,346

(22) Filed: Nov. 10, 2021

(65) Prior Publication Data

US 2022/0145630 A1 May 12, 2022

Related U.S. Application Data

(60) Provisional application No. 63/111,947, filed on Nov. 10, 2020.

(51) Int. Cl.
*E04C 3/02* (2006.01)
*E04G 3/22* (2006.01)
*E04G 5/06* (2006.01)

(52) U.S. Cl.
CPC ..... *E04C 3/02* (2013.01); *E04G 3/22* (2013.01); *E04G 5/064* (2013.01)

(58) Field of Classification Search
CPC ..... E04G 5/064; E04G 3/22; E04G 5/041; E04C 3/02
USPC ..... 182/112, 150, 222, 186.9; 248/317, 339, 248/235; 52/39
See application file for complete search history.

(56) References Cited

U.S. PATENT DOCUMENTS 276,241 A * 4/1883 Hanavan ..... A22C 15/003 248/340
2,057,092 A * 10/1936 Robert ..... G03B 15/02 182/113
2,925,240 A * 2/1960 Laviolette ..... E04G 3/28 248/228.2
3,021,919 A * 2/1962 Peters ..... E04G 3/18 182/178.1
3,084,893 A * 4/1963 Ruth ..... E04B 9/18 248/228.4
3,524,520 A * 8/1970 Tidwell ..... E04G 3/30 182/36
3,735,951 A * 5/1973 Reed ..... E04G 3/22 248/340
3,945,462 A * 3/1976 Griswold ..... E04G 5/045 248/231.51
4,276,959 A * 7/1981 Barber ..... B63C 5/02 248/323

(Continued)

FOREIGN PATENT DOCUMENTS

EP 0881341 A1 * 12/1998 ..... E04G 3/265

*Primary Examiner* — Brent W Herring
(74) *Attorney, Agent, or Firm* — Westman, Champlin & Koehler, P.A.

(57) ABSTRACT

A deck platform hanger/joist runner includes a flat platform, and a joist engager coupled to the flat platform. The joist engager includes a top joist engagement structure having a top joist engager and a bottom joist engagement structure having a bottom joist engager. The top joist engagement structure includes a pivot point configured to engage with a joist to pivot the deck platform hanger to engage the joist with the top joist engager and the bottom joist engager.

19 Claims, 10 Drawing Sheets

(56) References Cited

U.S. PATENT DOCUMENTS

| | | | | |
|---|---|---|---|---|
| 5,524,727 | A * | 6/1996 | Yennie, Jr. | E04G 3/20 182/150 |
| 6,227,330 | B1 * | 5/2001 | Preusser | E01D 19/106 182/150 |
| 2002/0027043 | A1 * | 3/2002 | Wisler | E04G 5/041 182/150 |
| 2006/0118361 | A1 * | 6/2006 | Wilcox | E04G 5/062 182/150 |
| 2006/0175130 | A1 * | 8/2006 | Riley | E04G 5/00 182/82 |
| 2006/0180392 | A1 * | 8/2006 | Scharff | E04G 5/06 182/82 |

* cited by examiner

DECK PLATFORM HANGER

CROSS-REFERENCE TO RELATED APPLICATION(S)

This application claims priority to U.S. provisional application No. 63/111,947, filed on Nov. 10, 2020, the content of which is hereby incorporated by reference in its entirety.

BACKGROUND

Installing deck material on a deck, such as a residential deck, is often difficult and taxing work. This is because the height of a deck surface is not conducive to the human body's natural shape and condition when installing deck planking. Further, many decks are elevated off the ground, and working on a ladder or the like requires moving the ladder often, and still may not place the installer's body at a comfortable height for installation of planks for the deck.

One issue in the installation of decking materials on framing is often bad elevation of the working surface for standing or kneeling for an installer. If the working surface is too high, such as at deck level or only a little below deck level, bending over is hard on the body. If the working surface is too low, installation is also difficult. Using ladders or extensive scaffolding is time consuming, expensive, and inefficient. Modern decks often use small fasteners and hidden clips, and working at an inefficient height makes installing deck boards time consuming and physically difficult.

SUMMARY

In one embodiment, a joist runner includes a flat platform, and a joist engager coupled to the flat platform. The joist engager includes a top joist engagement structure having a top joist engager and a bottom joist engagement structure having a bottom joist engager. The top joist engagement structure includes a pivot point configured to engage with a joist to pivot the deck platform hanger to engage the joist with the top joist engager and the bottom joist engager.

In another embodiment, a joist runner includes a flat platform and a joist engager coupled to the flat platform. The joist engager includes a top joist engagement structure having a top joist engager and a bottom joist engagement structure having a bottom joist engager. The top joist engagement structure includes a pivot point configured to engage with a joist to pivot the deck platform hanger to engage the joist with the top joist engager and the bottom joist engager. The top joist engager includes a side bracket, a top joist bracket, and a roller. The side bracket is substantially parallel to a side face of the main body, and the top joist bracket is positioned between the side bracket and the main body to form a structure into which a top of a joist can be fit. The roller is rotatably mounted between the side bracket and the main body and is rotatable about an axis extending perpendicular to the side face of the main body. The bottom joist engager includes a bottom joist bracket and a joist side weldment secured to the bottom joist bracket to extend substantially parallel to a side face of the main body. The side weldment, the bottom joist bracket, and the main body form a structure into which a bottom of a joist can be fit.

In another embodiment, a method of preparing a deck installation platform includes mounting a first joist runner, having a first flat platform, on a first joist; and mounting a second joist runner, having a second flat platform, on a second joist. A working surface is placed to bridge between the first flat platform and the second flat platform. The first joist runner and the second joist runner each include a joist engager coupled to the flat platform, each joist engager including a top joist engagement structure having a top joist engager and a bottom joist engagement structure having a bottom joist engager, for engaging a top and a bottom of the joist therebetween.

DETAILED DESCRIPTION

Embodiments of the present disclosure provide joist runners/hangers for easy and removable mounting to joists of a deck, or to other structural components, including but not limited to rafters, roof decking, flooring, decking on mobile equipment, and the like, for the installation of deck boards over the structure. The embodiments of the present disclosure provide a safe, efficient, properly dimensioned hanger on which any board or scaffold piece may be laid, and laid at a level conducive to easy access to the decking surface without putting excess strain on an installer.

Figure 1:
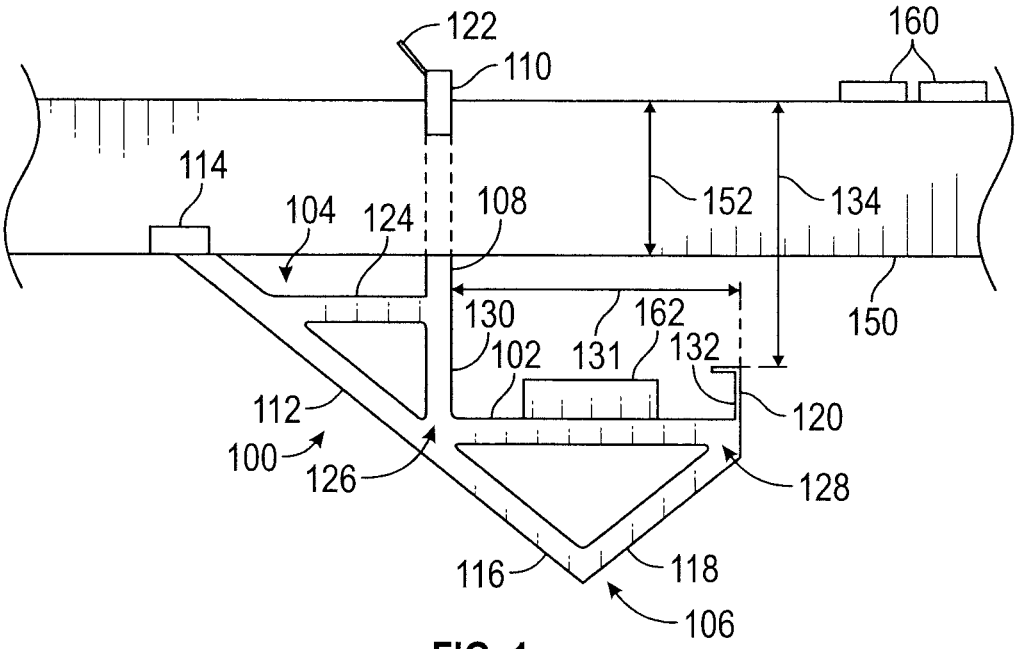
FIG. 1 is a side elevation view of a deck platform hanger according to an embodiment of the present disclosure.

In one embodiment, a deck platform hanger/joist runner 100 is shown in side elevation view in FIG. 1. Deck platform hanger 100 comprises, in one embodiment, a flat platform 102, a joist engager 104 coupled to the flat platform 102, and a flat platform support 106. Joist engager 104 comprises, in one embodiment, a top joist engagement arm 108 having a top joist engager 110 and a bottom joist engagement arm 112 having a bottom joist engager 114. The top engagement arm 108 extends upward from and substantially perpendicular to the flat platform 102. The bottom joist engagement arm 112 extends upward from and at an obtuse angle to the flat platform 102. The top joist engagement arm 108 and the bottom joist engagement arm 112 form an acute angle therebetween in one embodiment.

The flat platform support 106 comprises, in one embodiment, an extension 116 of the bottom engagement arm 112, and a flat platform support arm 118. The extension 116 and the flat platform support arm 118 are arranged in one embodiment to form a v-shaped support of the flat platform 102, underneath the flat platform 102. One end 126 of extension 116 supports a first end 130 of the flat platform 102. One end 128 of flat platform support arm 118 supports a second end 132 of the flat platform 102, and the opposite ends of the extension 116 and the flat platform support arm join at the v of the v-shaped flat platform support 106.

In one embodiment, the top joist engager 110 is a c-shaped component with an opening facing downward toward a top of a joist 150. The top joist engager 110 is sized in one embodiment to fit a 2 inch side 154 of a 2 inch wide×10 inch high joist 150, although it should be understood that different sizes of joist engagers 104 may be used without departing from the scope of the disclosure. However, 2×10 inch joists 150 are traditional, so the discussion of the deck platform hanger 100 herein are referring to a 2×10 inch joist 150. The c-shaped component faces downward with respect to a top of a joist 150, fitting around the top of the joist 150 to engage it.

The top joist engager 110 in one embodiment further includes a kick plate 120 extending from the top joist engager 110 at an angle. The kick plate 120 extends in one embodiment upward from a top of the top joist engager 110 and provides a platform for moving the deck platform hanger 100 by striking the kick plate 120. An optional brace 124 extends between the top joist engagement arm 108 and the bottom joist engagement arm 112.

In one embodiment, the bottom joist engager 114 is a c-shaped component with an opening facing upward toward a bottom of a joist 150. The bottom joist engager 114 is also sized in one embodiment to fit the 2 inch side 154 of a 2×10 inch joist 150, although it should be understood that different sizes of joist engagers 104 may be used without departing from the scope of the disclosure. However, 2×10 inch joists are traditional, so the discussion of the deck platform hanger 100 herein are referring to a 2×10 inch joist. The c-shaped component faces upward with respect to a bottom of a joist, fitting around the bottom of the joist to engage it.

Figure 2:
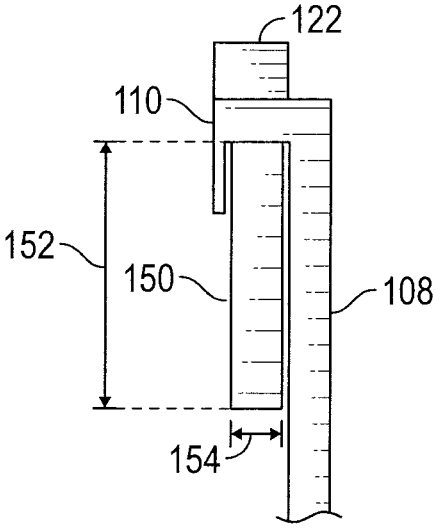
FIG. 2 is a partial end view showing a top joist engager engaged with a joist.
Figure 3:
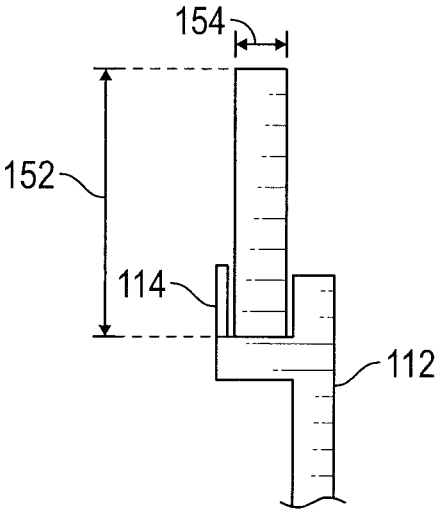
FIG. 3 is a partial end view showing a bottom joist engager engaged with a joist.
Figure 4:
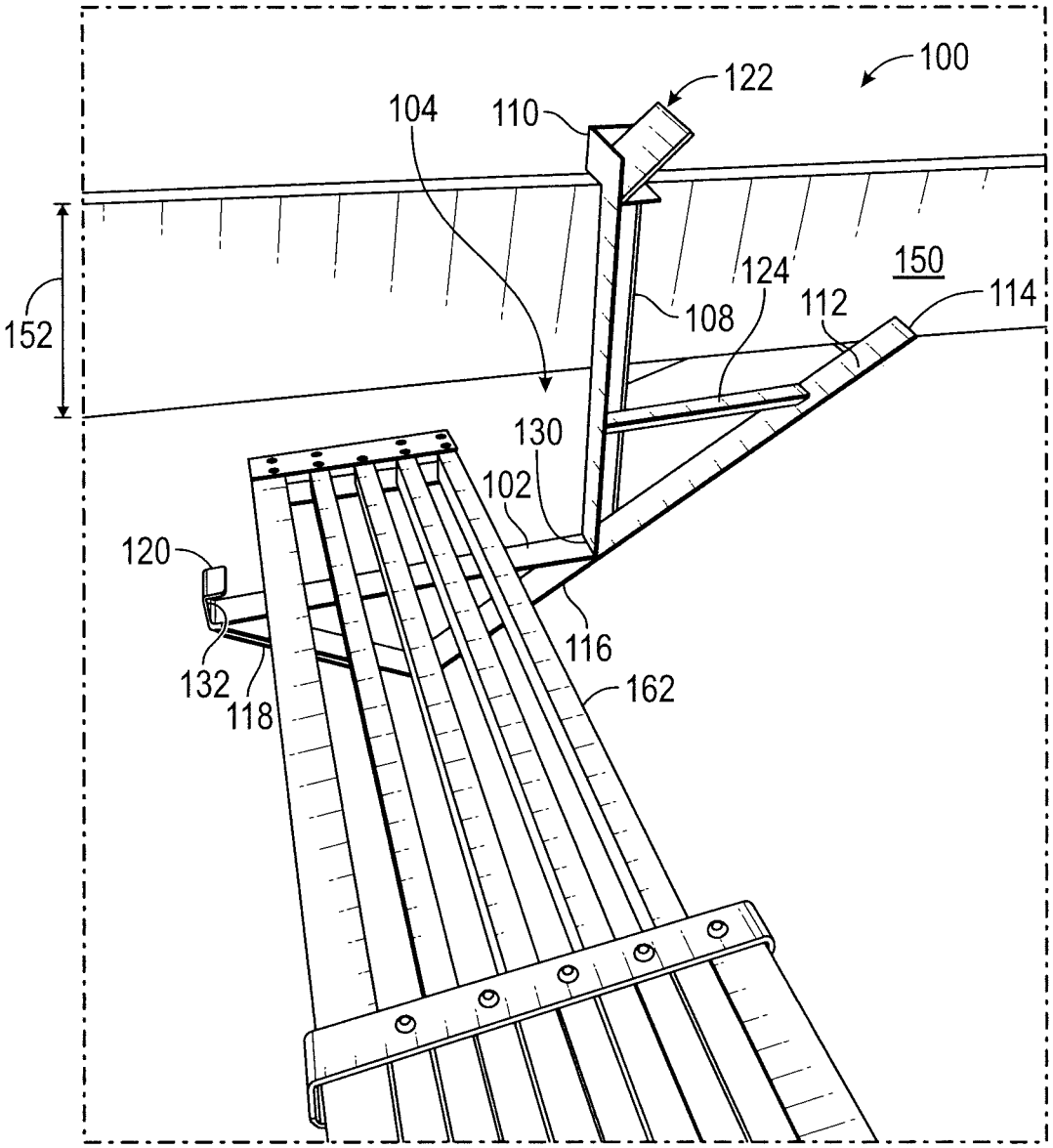
FIG. 4 is a first side perspective view of a deck hanger according to an embodiment of the present disclosure in place on a joist.
Figure 5:
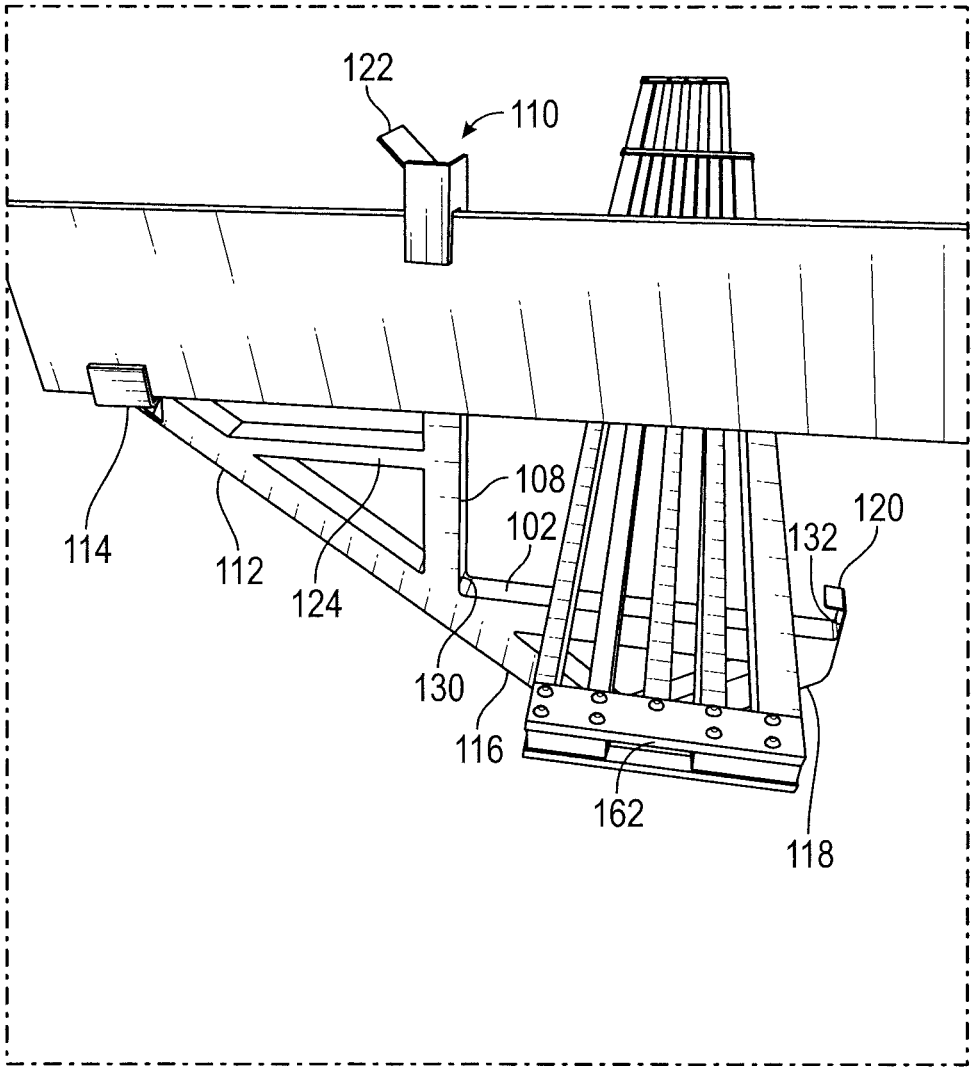
FIG. 5 is a second side perspective view, opposite the first side view, of the deck hanger of FIG. 4.
Figure 6:
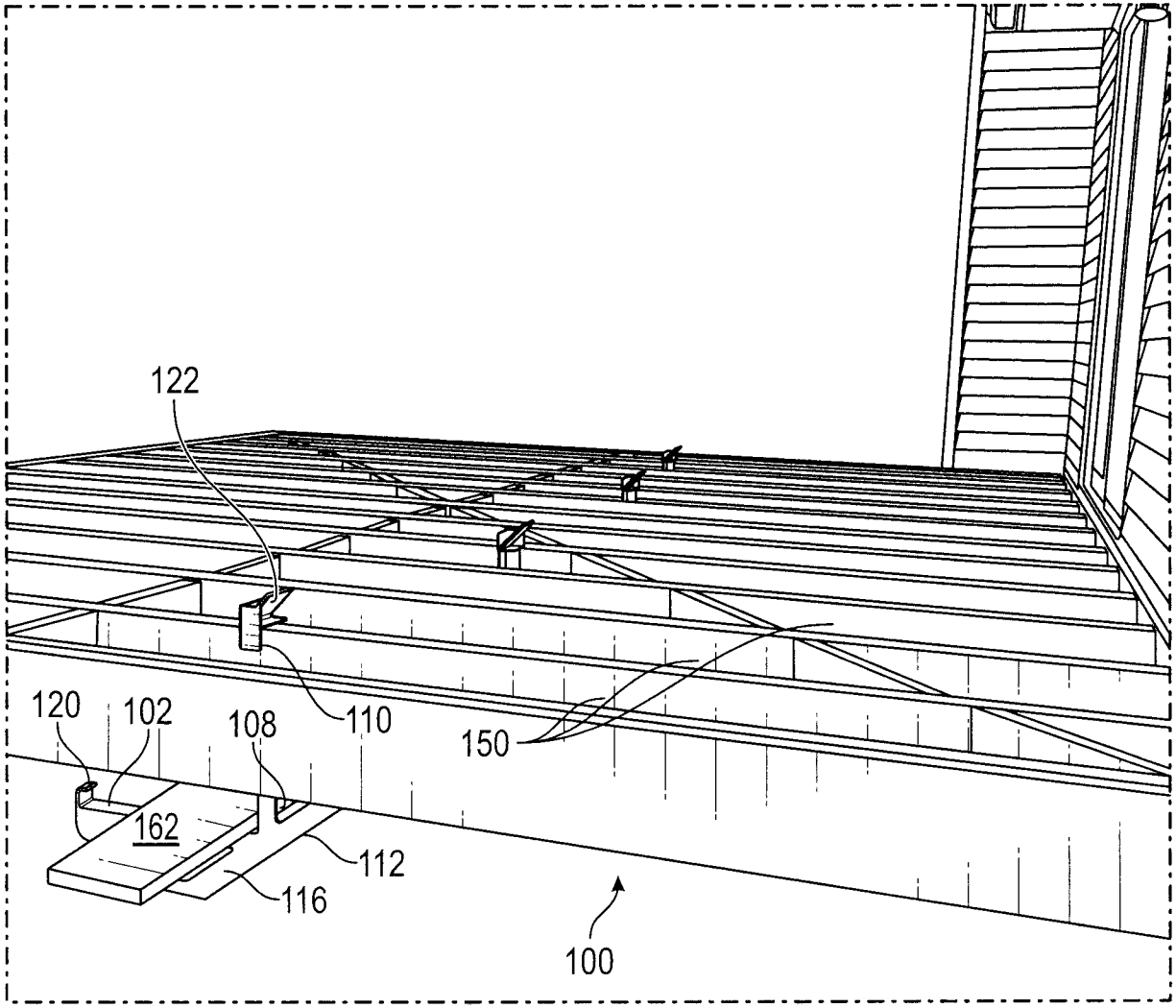
FIG. 6 is a perspective view of a number of deck hangers in place on joists of a deck according to an embodiment of the present disclosure.
Figure 7:
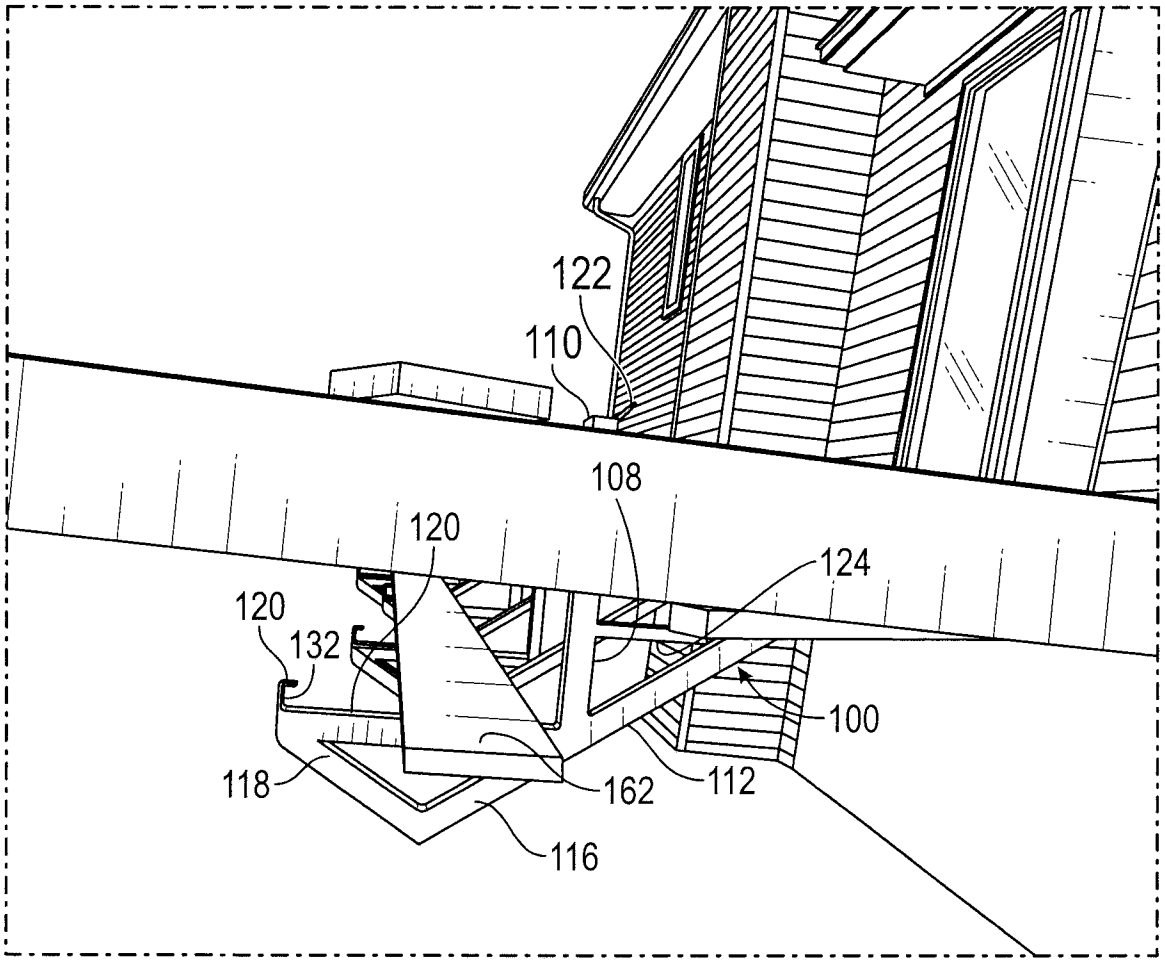
FIG. 7 is a close-up view of deck hangers in place on joists of a deck according to an embodiment of the present disclosure.
Figure 8:
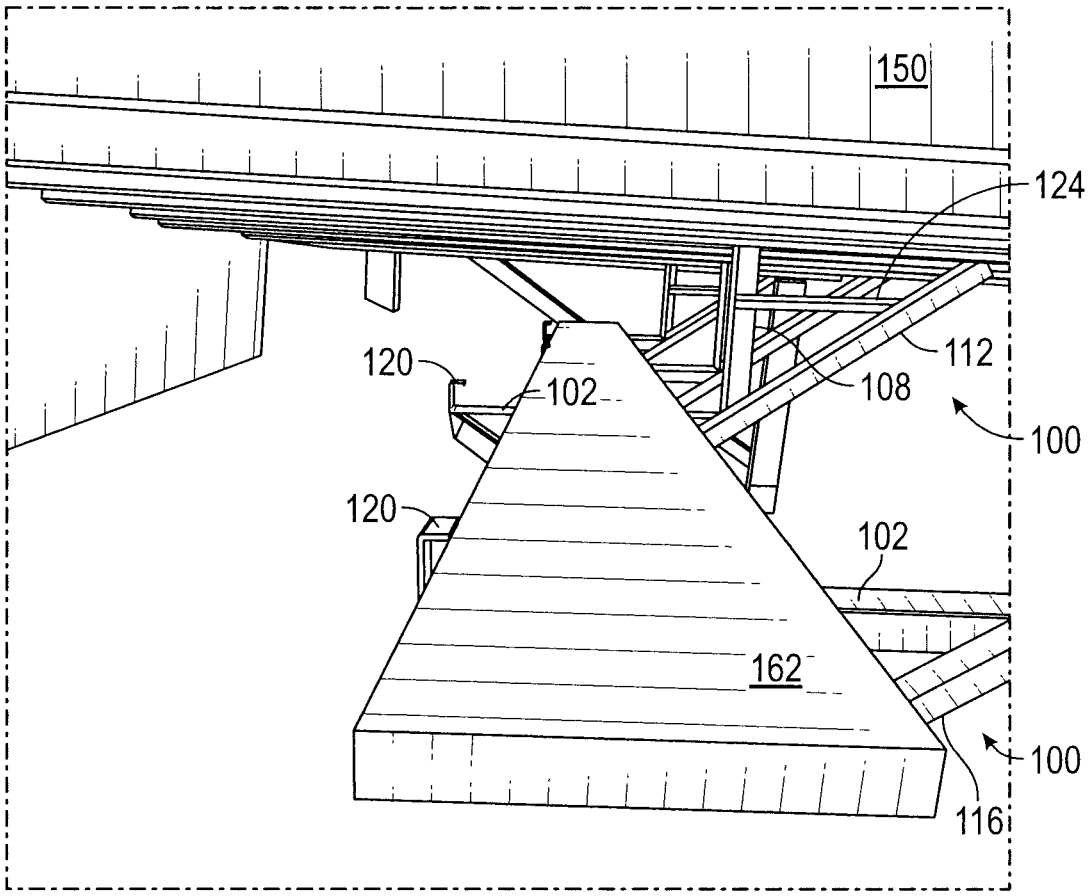
FIG. 8 is a close-up view of a deck hanger in place on a joist of a deck, along with planking, according to an embodiment of the present disclosure.
Figure 9:
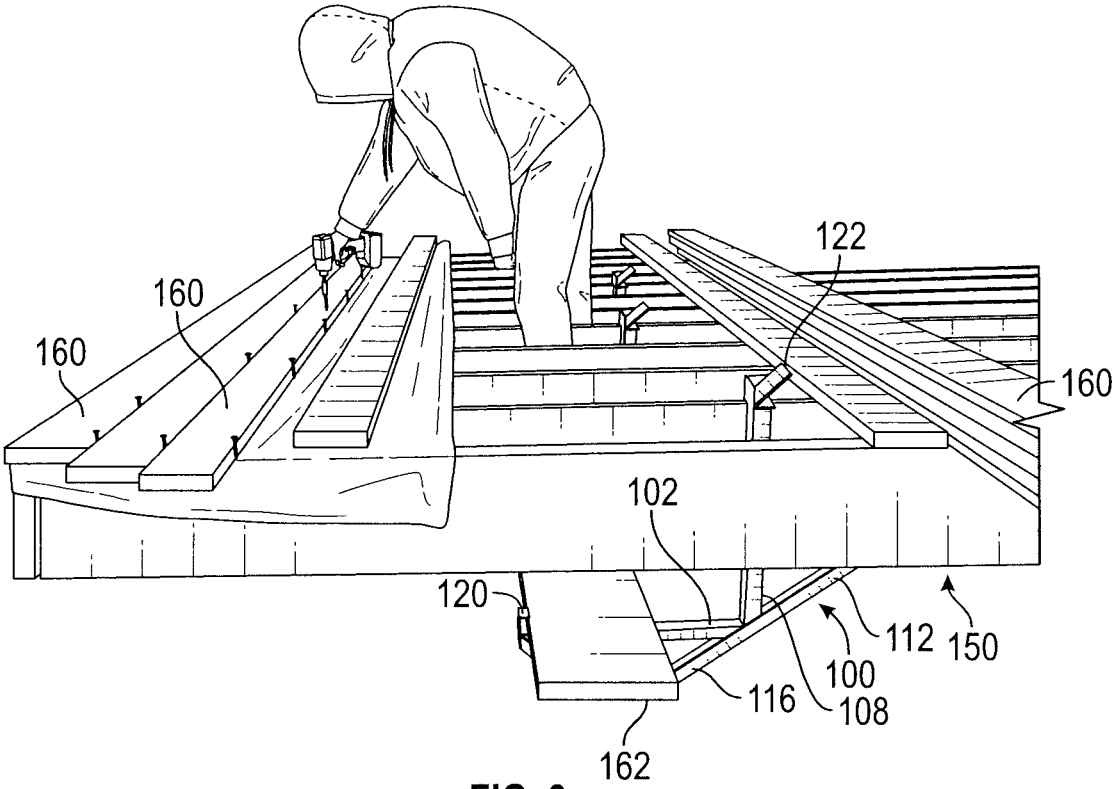
FIG. 9 is a perspective view of deck hangers of the present disclosure in place and operational for installation of deck boards for a deck.

The top and bottom joist engagers 110 and 114 cooperate to engage a joist 150, with height 152 and width 154, on its top and its bottom to provide a stable and secure deck platform hanger 100. A side view of the top joist engager 110 in place on a joist 150 is shown in FIG. 2. A side view of the bottom joist engager 114 in place on a joist 150 is shown in FIG. 3.

As can be seen in FIGS. 4-9, the c-shaped top joist engager 110 is laterally displaced from the top joist engager arm 108, and the c-shaped bottom joist engager 114 is laterally displaced from the bottom joist engager arm 112. This offset allows easy mounting of the deck platform hanger on a joist, as described further below.

The deck platform hanger 100 also includes in one embodiment a hook 120 at the end 132 of the plank support 102. The hook 120 extends upward from the plank support 102, and then extends back toward the top joist engagement arm 130 to form a stop for planking used with the deck platform hanger 100 on which an installer kneels or stands. Ends 130 and 132 are in one embodiment separated by a distance 131 of greater than 20 inches, to allow one or two 2×10 joists to be used as planking 162 for a working surface. The hook 120, as well as a plank 162 supported on plank support 102 for an installer, is shown in greater detail in FIGS. 4 and 5.

Although they have been described separately, it should be understood that the bottom joist engagement arm 112 and the extension 116 comprise a single piece of material in one embodiment, and that is how they are shown in the FIGS. In one embodiment, the deck platform hanger 100 is made of steel, but it should be understood that the material used for the deck platform hanger 100 may be any material of sufficient strength to brace against and with a joist, and to support weight of planking and installers on multiple deck platform hangers mounted on multiple joists.

Deck platform hangers/joist runners 100 are shown in place on joists of a deck, with planking 162, and installers, in FIGS. 6-9. FIGS. 6-9 also show further detail of the deck platform hanger 100 from a variety of angels.

In operation, more than one deck platform hanger 100 is used to support planking or a platform for a working surface for an installer to install deck boards at deck level. Each hanger 100 hooks directly to a joist using a pendulum motion, using torque to fully seat the hanger on a joist. This design allows the swing of the pendulum via torque to be terminated into the joist. The top joist engager 110 is placed over a top of a joist with the end 132 raised. Once the top joist engager is seated, the weight of the flat platform 102 and flat platform support 106 allow a natural gravitational swing that raises bottom joist engager 114 to meet a bottom of the joist. Thereby, the top joist engager 110 and the bottom joist engager 114 sandwich the joist therebetween in a stable manner.

When in place on a joist 150, the deck platform hanger 100 is engaged with the joist via the top joist engager 110 and the bottom joist engager 114. In one embodiment, the flat platform 102, when the deck platform hanger 100 is in place on a joist 150, is at a height 134 approximately 19-20 inches below a top of the joist 150. This height 134 provides a comfortable difference between a working height and a deck surface height. Such a position increases efficiency and speed in the placement of deck boards 160 onto a deck, since an installer is positioned at a proper working height conducive to less stretching and bending for installation of deck boards. The working height 134 of 19-20 inches is knee height for most adults. Knee height is a very good position for reach, body elevation, and efficiency. It should be understood that the 19-20 inch height 134 is exemplary, and that different heights 134 could be provided without departing from the scope of the disclosure.

Planking for use with the deck platform hangers of the present disclosure may determine how many hangers 100 are used for support of the planking. For example, if planking is rated for 50 pounds, hangers 100 may be placed every other joist to provide proper support. If planking is rated for more weight, fewer hangers 100 may be used, spaced farther apart on joists.

Figure 10:
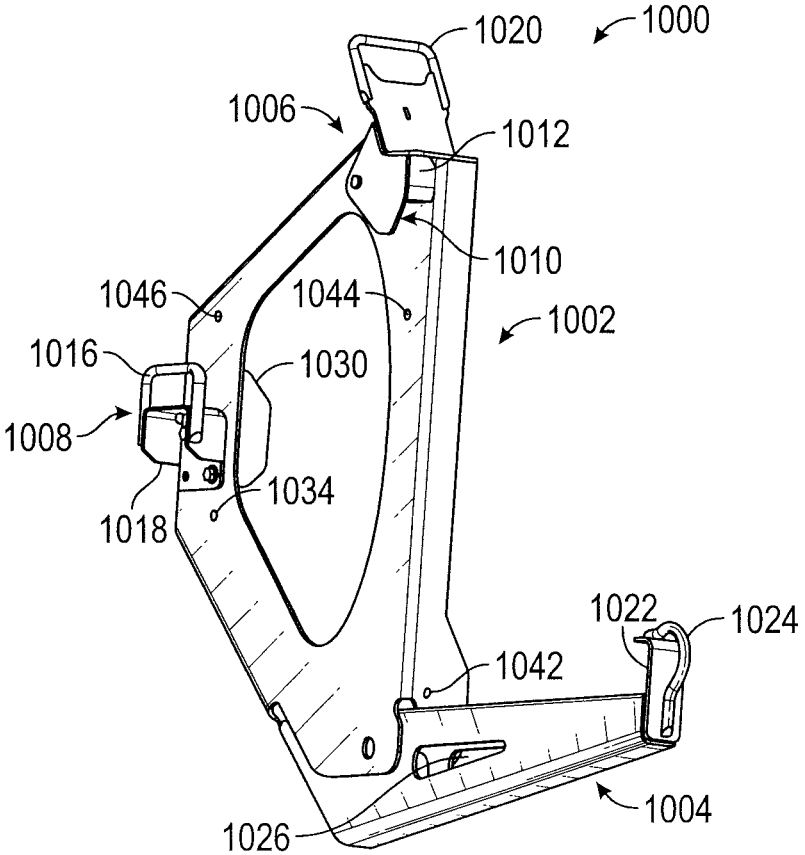
FIG. 10 is a perspective view of a joist runner according to another embodiment of the present disclosure.
Figure 11:
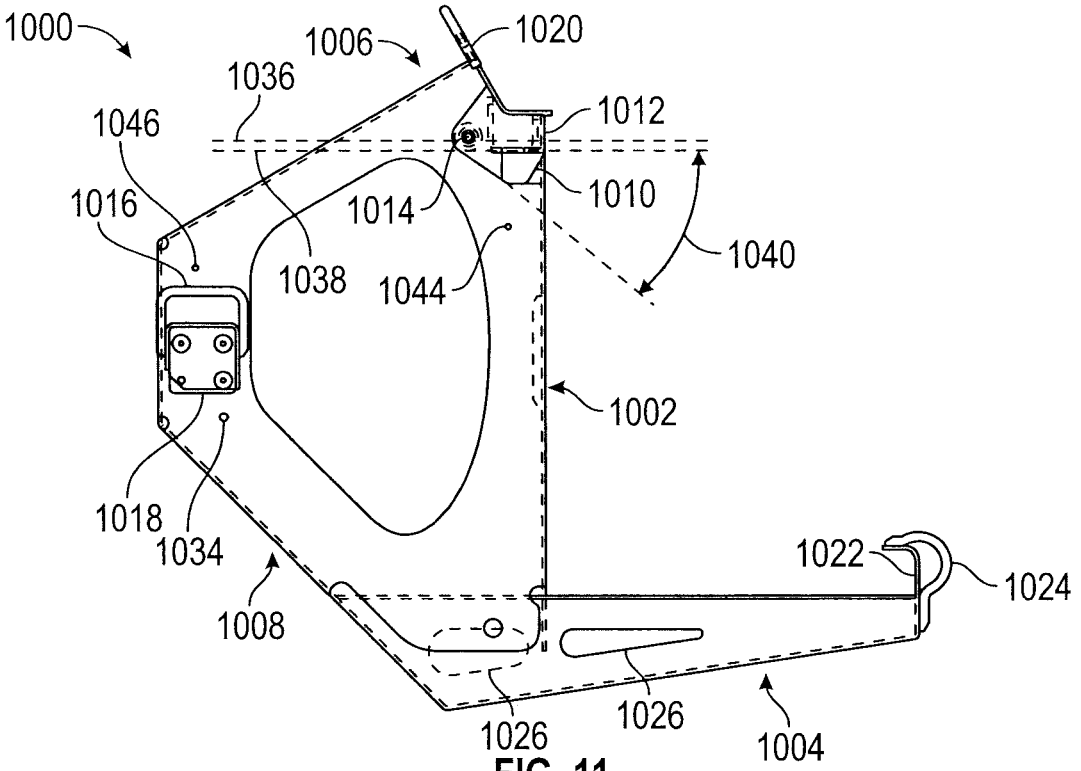
FIG. 11 is a side elevation view of the joist runner of FIG. 10.
Figure 12:
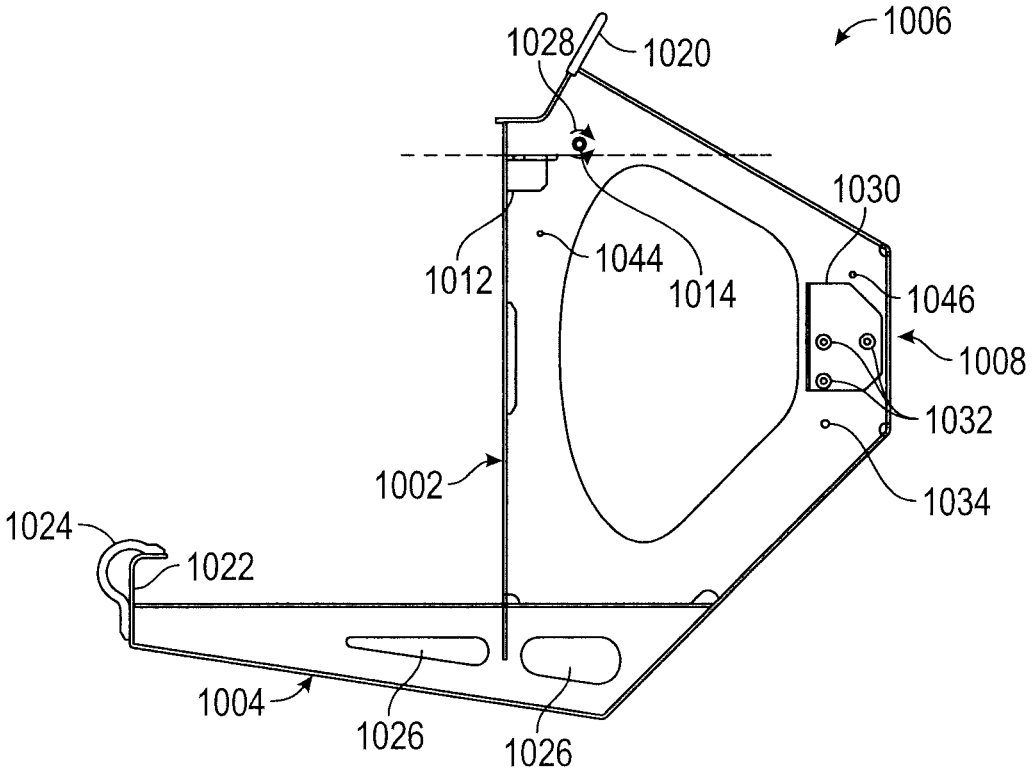
FIG. 12 is an opposite side elevation view of the joist runner of FIG. 10.

Another embodiment of a structure installation hanger/joist runner 1000 is shown in FIGS. 10-12. FIG. 10 is a perspective view, FIG. 11 is a side elevation view, and FIG. 12 is an opposite side elevation view. Joist runner 1000 comprises in one embodiment a main body 1002 and a flat platform 1004. Main body 1002 includes a top joist engagement structure 1006 and a bottom joist engagement structure 1008.

Top joist engagement structure 1006 includes in one embodiment a top joist engager which comprises side bracket 1010, top joist bracket 1012, and roller 1014. Roller 1014 is rotatably mounted to rotate as shown in arrows 1028 (FIG. 12). Top joist bracket 1012, side bracket 1010, and main body 1002 form a structure into which a top of a joist fits.

Bottom joist engagement structure 1008 includes in one embodiment a bottom joist bracket 1018 and a joist side weldment 1016 secured to the bottom joist bracket. The side weldment 1016, bottom joist bracket 1018, and main body 1002 form a structure into which a bottom of a joist fits. The bottom joist bracket 1018 is in one embodiment secured to the main body by a back bracket 1030 using bolts 1032 through openings 1034 in the main body 1002.

A set of openings 1034 are provided in one embodiment that allow the position of the bottom joist bracket 1018 and back bracket 1030 to be adjusted up or down to adjust a distance between a top of the bottom joist bracket 1018 and a bottom of the top joist bracket 1012. This adjustment is made to accommodate a different nominal sized joist. In one embodiment, a nominal 2 inch by 10 inch joist is accommodated. Adjustment of the position of the bottom joist engager by moving the bottom joist bracket 1018 and back bracket 1030 allows for accommodation of a different size joist, for example a nominal 2 inch by 12 inch joist. The sizes of joists that may be accommodated by the top and bottom joist engagers and movement thereof is not limited to those sizes discussed. It should be understood that different size joists may easily be accommodated without departing from the scope of the disclosure.

Roller 1014 is in one embodiment a polyethylene (poly) roller that is rotatably movable within bracket 1010 and main body 1002. The poly roller 1014 is positioned to limit an amount of tipping action that can be done on the joist runner 1000. Overcamming to move the side bracket 1010 past a top of a joist by pivoting about the roller 1014 allows the joist runner 1000 to be moved laterally off of a joist. Handle 1020 is provided in one embodiment at a top of the main body 1002. In conjunction with roller 1014, handle 1020 is used in one embodiment to move the joist runner 1000 along a joist without disengaging from the joist. Applying pressure on handle 1020 in the direction of arrow 1048 causes the joist runner 1000 to cam away from the joist and engage the roller 1014. This action allows a user to move the joist runner 1000 using the roller 1014 and pressure. Handle 1024 may also be used alone or in combination with handle 1020 to assist in camming the joist runner 1000 to engage roller 1014. Handle 1024 allows for lifting of the joist runner 1000 to effect camming thereof onto the roller 1014.

Overcamming of the joist runner 1000 to a point where the side bracket 1010 is rotated through an angle 1040 sufficient to disengage laterally from the joist allows removal of the joist runner 1000 from the joist. Roller 1014 is positioned so that its outer surface is at a position (e.g., height) 1036 slightly above a bottom position (e.g., height) 1038 of the top joist bracket 1012 when the joist runner 100 is engaged with the joist for use. When the joist runner 1000 is cammed by pressure to the handle 1020 (and/or to handle 1024), the roller 1014 is engaged while a portion of the side bracket 1010 is still engaged with the joist, along with the main body 1002. In that manner, the joist runner 1000 does not disengage completely from the joist until the joist runner 1000 is rotated to an angle above angle 1040 (see FIG. 11). When the joist runner 1000 is overcammed above the angle 1040, it may be laterally removed from the joist. Pressure on the flat platform 1004 creates a full engagement of the top joist engager 1006 with a top of a joist, and of the bottom joist engager 1008 with a bottom of a joist. The roller 1014 allows easy movement of the joist runner 1000 along the joist, as pressure is on the roller 1014 and not the joist.

The kick plate of the embodiment of FIG. 1 is replaced in the embodiment of FIG. 10 with handle 1020 at the top joist engager 1006 and handle 1024 at the flat platform 1004 distal end. When not in place on a joist, the handles 1020, 1024, as well as joist side weldment 1016, may be used as movement handles.

While structures that contain a joist on three sides have been shown as top joist engager 1006 and bottom joist engager 1008, it should be understood that different structures suitable for containing a joist in similar fashion may be used without departing from the scope of the disclosure. Such different structures include, by way of example only and not by way of limitation, clamps, screw clamps, and the like.

In some situations, such as where a platform for working is elevated, safety considerations would dictate or even require more permanent attachment of joist runners to joists. In such circumstances, holes provided in embodiments of the joist runner 1000 may be used to screw or nail the joist runner to a joist, or to secure a working platform to the flat platform 1004 Representative holes are shown in the FIGS. As holes 1042, 1044, and 1046, although additional holes could be provided without departing from the scope of the disclosure. Holes 1044 and 1046, for example, may be used to screw a joist runner 1000 to a joist. Hole 1042 (see FIG. 10) may be used to screw a platform such as platform 1401 (see FIG. 14) to the joist runner.

Additionally, in one embodiment, strap openings 1026 are provided in flat platform 1004. The strap openings 1026 may be used in conjunction with handle 1024 in one embodiment to strap or otherwise affix a platform such as 1404 to flat platform 1004. For example, a strap (not shown) could be run through both handle 1024 and strap opening 1026 to secure a platform 1404 to the flat platform 1004. Alternatively, a strap could be run through strap opening 1026, around a platform, and back, to secure the platform.

While level joists are discussed, it should be understood that the embodiments of the present disclosure could be used on non-level joists, such as roof joists which sit at an angle. For example, the joist runners could be used while mounted to joists/rafters of a pitched roof, with the screw holes 1042, 1044, 1046, and potentially further anti-slide connections. In such an instance, the flat platform portion 1004 of a joist runner 100 could be angled to compensate for the pitch of the roof, so as to provide a level working platform.

In another embodiment, the ergonomic working height below a working surface could be adjusted with either a taller main body 1002, or an adjustable height flat platform 1004, without departing from the scope of the disclosure. Additionally, further flat platforms like flat platform 1004 could be provided in a stepped or chair fashion, allowing a worker to sit on one flat platform and stand on another, to obtain proper working height. Embodiments of the disclosure could also be used elsewhere, such as, for example, for installing decking such as hardwood and composite flooring with open joists, installation of decking on mobile equipment such as flatbed trailers, tooling, manufacturing, or the like. In all embodiments and uses, any terrain of feature underneath the platform does not have a bearing on the working area provided by a platform on joist runners. Therefore, whether the ground below is a few feet or many feet, whether it is rough, broken, muddy, wet, or the like, does not affect operation of the joist runners and platform. The working area is consistent and level.

As to elevation, for example, instead of scaffolding or a ladder being required for installation of decking material on an elevated deck, the embodiments described herein are supported by the joists to allow for quick installation of decking at a proper ergonomic height without the use of expensive and time consuming scaffolding, or unstable and dangerous ladders. The joist runners allow a working platform 1404 to be placed at a proper height relative to the tops of the joists without scaffolding and ladders.

Embodiments of the present disclosure can be manufactured from any number of suitable materials. materials include but are not limited to metal, sheet metal, aluminum, composites, or the like.

Figure 13:
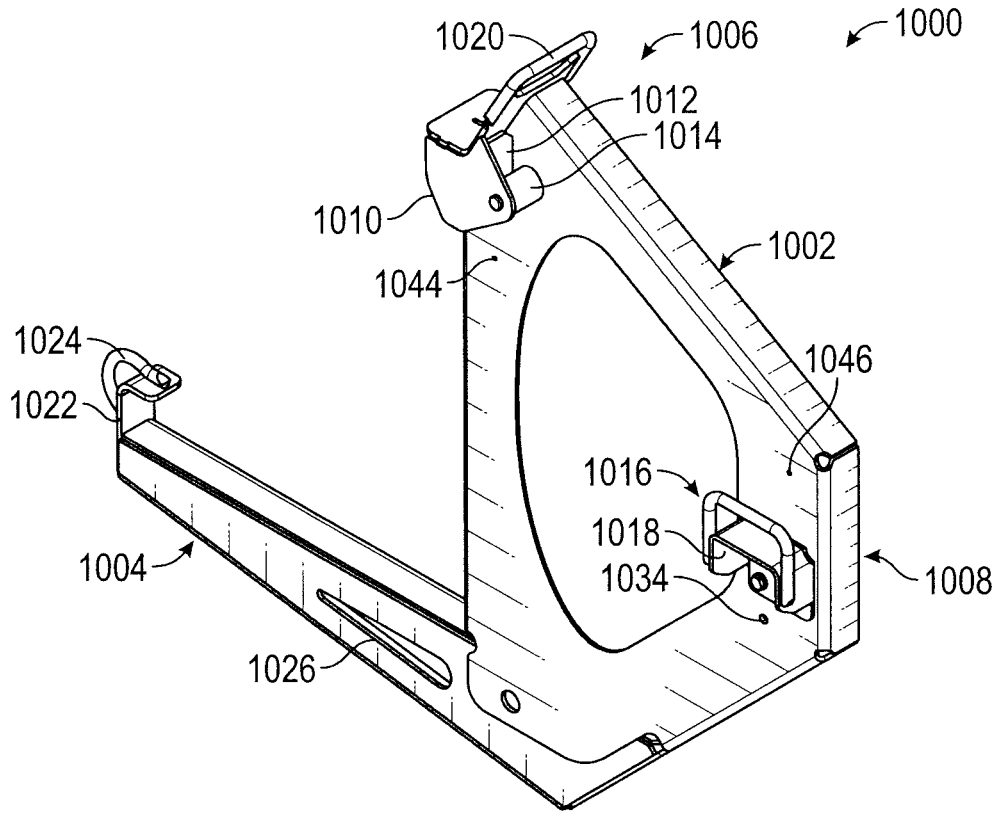
FIG. 13 is a perspective view of a joist runner of opposite handedness than the joist runner of FIG. 10.

In one embodiment, joist runners of opposite construction are provided. That is, the side of the main body 1002 on which the top and bottom joist engagement structures 1006 and 1008 are different. For example, a right hand joist runner is shown in FIGS. 10-12. A left hand joist runner is shown in FIG. 13.

Figure 14:
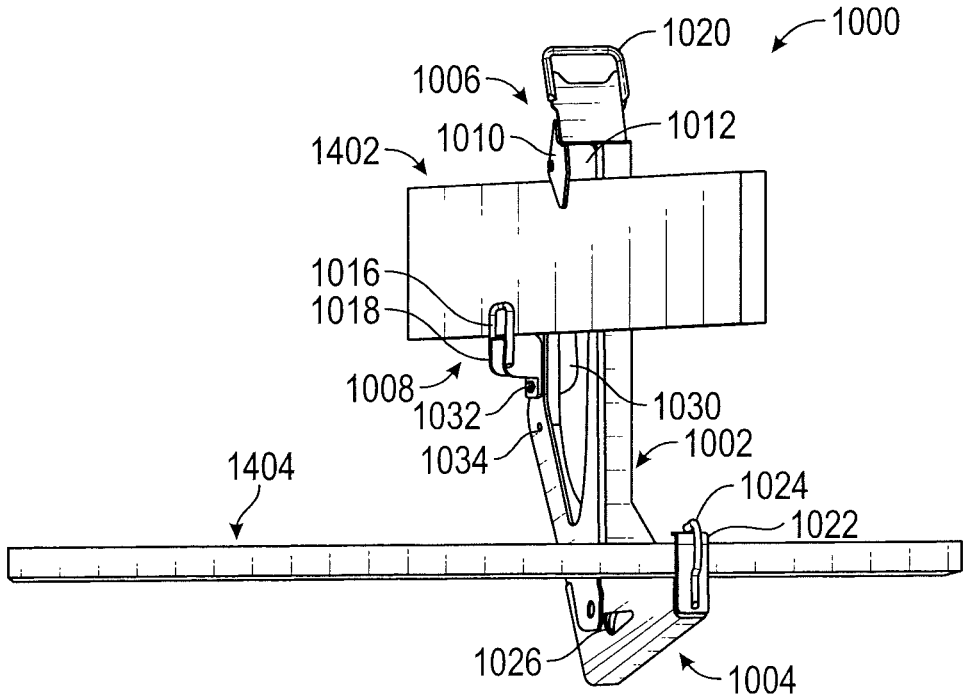
FIG. 14 is a perspective view of a joist runner in place on a joist and with a platform, in accordance with an embodiment of the present disclosure.

FIG. 14 shows a partial view of a joist runner 1000 engaged on a joist 1402, supporting a platform 1404.

Figure 15:
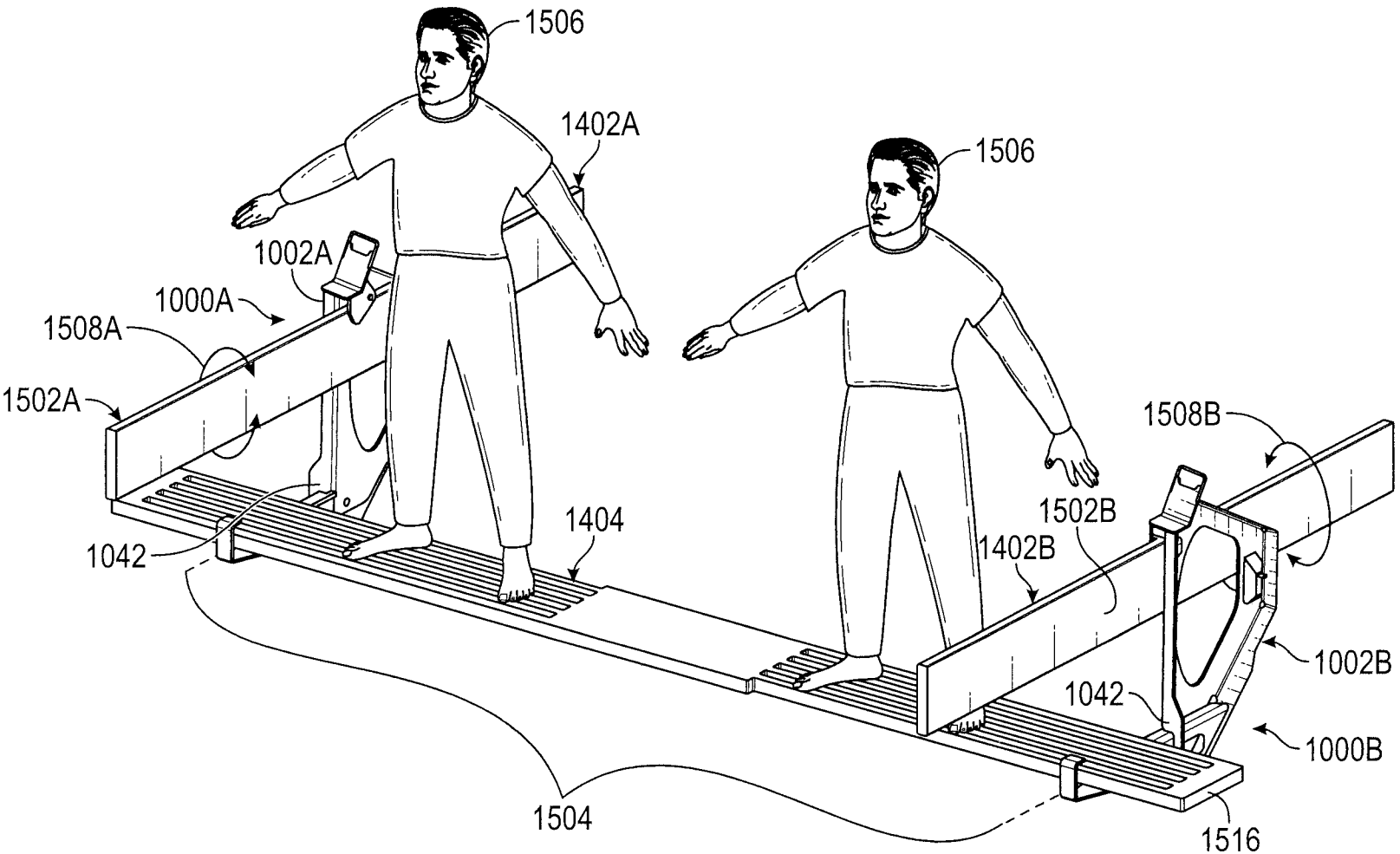
FIG. 15 is a perspective view of a pair of joist runners of the present disclosure in use with joists, a platform, and holding users.

In FIG. 15, both a left hand joist runner 1000A (such as shown also in FIG. 13) and a right hand joist runner 1000B (such as shown also in FIGS. 10-12) are shown in use. The side where the joist engagers are located on the joist runners 1000A and 1000B are different. In one embodiment, in order to reduce a twisting effect on the joist runners 1000A and 1000B in use, each joist runner engages on an opposite side of the joist from where a work platform is. Two joist runners of opposite configuration are used, for example one left joist runner 1000A and one right joist runner 1000B as shown in FIG. 15. In FIG. 15, the top and bottom joist engagers of joist runner 1000A and the top and bottom joist engagers of joist runner 1000B are on opposite sides of the respective joists 1402A and 1402B from the working area 1504 of platform 1404.

As shown in FIG. 15, a left joist runner 1000A has its main body 1002A on a far side 1502A of the joist 1402A from the working area 1504 between the joists 1402A and 1402B, and a right joist runner 1000B has its main body 1002B on a far side 1502B of the joist 1402B from the working area 1504. In this way, the pressure of downward force on the working platform 1404 due to the weight of the platform 1404, the hangers 1000A and 1000B themselves, and any worker(s) 1506 on the platform, does not allow for twisting of the hangers 1000A and 1000B about the arrows 1508A and 1508B.

A method of preparing a deck installation platform comprises, in one embodiment, mounting a first joist runner, having a first flat platform, on a first joist, mounting a second joist runner, having a second flat platform, on a second joist; and placing a working surface bridged between the first flat platform and the second flat platform. In this embodiment, the first joist runner and the second joist runner each include a joist engager coupled to the flat platform, each joist engager comprising a top joist engagement structure having a top joist engager and a bottom joist engagement structure having a bottom joist engager, for engaging a top and a bottom of the joist therebetween.

The joist runners are arranged in one configuration to place their flat platforms at an ergonomic working height below a decking surface, for installation of deck boards on the decking surface. A worker then may work from the working surface for installation of deck boards on top of the joists of a deck.

As has been mentioned earlier herein, moving a joist runner along a joist includes in one embodiment moving a joist runner on a joist by tipping the joist runner to a first angle onto a rotatable roller of its top joist engager for movement of the joist runner along a joist without laterally disengaging the joist. To disengage from the joist, the joist runner is tipped to a second angle larger than the first angle, to a point at which the second angle is sufficient to move the top joist engager above a top of the joist to allow lateral disengagement from the joist.

Embodiments of the present disclosure provide structures such as deck platform hangers/joist runners that allow engagement with both a top and a bottom of a joist for providing a stable and secure platform rest for a platform used by workers installing decking material, such as on a deck or other surface joists, as shown and described herein. A platform is laid across at least two hangers/joist runners to provide an ergonomically correct elevation difference between a working height and a standing/sitting/kneeling height of the working platform 1404. The act of applying load to the joist engagers creates a stable and firm connection between the joist engagers and a joist.

Joist runners 1000 of the disclosure are designed to meet ANSI standards for strength and loading, and are provided with the safety openings in the form of holes 1042, 1044, and 1046.

Although the present disclosure has been described with reference to preferred embodiments, workers skilled in the art will recognize that changes may be made in form and detail without departing from the spirit and scope of the disclosure.

What is claimed is:

1. A joist runner, comprising:

a flat platform;

a joist engager coupled to the flat platform, the joist engager comprising a top joist engagement structure having a top joist engager and a bottom joist engagement structure having a bottom joist engager, the top joist engagement structure comprising a pivot point configured to engage with a joist to pivot the joist runner to engage the joist with the top joist engager and the bottom joist engager;

a bottom joist bracket; and a joist side weldment secured to the bottom joist bracket to extend substantially parallel to a side face of the main body;

wherein the side weldment, the bottom joist bracket, and the main body form a structure into which a bottom of a joist can be fit.

2. The joist runner of claim 1, wherein the top joist engager is a c-shaped component with an opening facing downward toward a top of the joist.

3. The deck platform hanger of claim 2, wherein the top joist engager and the bottom joist engager are laterally displaced from the main body.

4. The joist runner of claim 1, wherein the bottom joist engager is a c-shaped component with an opening facing upward toward a bottom of the joist.

5. The joist runner of claim 1, and further comprising a handle extending from the top joist engager at an angle.

6. The joist runner of claim 5, wherein the handle is configured to move the deck platform hanger along the joist by reducing a force of engagement of the top joist engager and bottom joist engager with the joist.

7. The joist runner of claim 1, and further comprising a plank securing structure at an end of the flat platform distal to the joist engager, for engaging a front of a plank.

8. The deck platform hanger of claim 1, wherein, when in place on a joist, the flat platform is disposed at an ergonomic working position below a top of the joist.

9. The joist runner of claim 1, wherein the top joist engager and the bottom joist engager are adjustably spaced to accommodate a joist therebetween.

10. The joist runner of claim 9, wherein the bottom joist engager is adjustably mounted to the main body.

11. The joist runner of claim 1, wherein the flat platform further comprises a strap opening therein, the strap opening configured to provide a securing location for a strap to secure a platform to the flat platform.

12. The joist runner of claim 1, wherein the top joist engager further comprises:

a side bracket;

a top joist bracket; and a cam having a roller;

wherein the side bracket is substantially parallel to a side face of the main body, and the top joist bracket is positioned between the side bracket and the main body to form a structure into which a top of a joist can be fit; and wherein the roller is rotatably mounted between the side bracket and the main body, and is rotatable about an axis extending perpendicular to the side face of the main body.

13. The joist runner of claim 12, wherein the roller is positioned to engage a joist when the joist runner is cammed to a first angle to allow the joist runner to be moved along a joist by rolling the roller on the joist while remaining laterally engaged with the joist in the structure into which a top of a joist can be fit, and to disengage laterally from the joist when the joist runner is cammed to a second angle greater than the first angle.

14. The joist runner of claim 1, and further comprising a back bracket, where the bottom joist bracket is secured to the main body by the back bracket on an opposite side face of the main body.

15. A joist runner, comprising:

a flat platform; and a joist engager coupled to the flat platform, the joist engager comprising a top joist engagement structure having a top joist engager and a bottom joist engagement structure having a bottom joist engager, the top engagement structure comprising a pivot point configured to engage with a joist to pivot the joist runner to engage the joist with the top joist engager and the bottom joist engager;

wherein the top joist engager further comprises a side bracket, a top joist bracket, and a roller, the side bracket substantially parallel to a side face of the main body, and the top joist bracket positioned between the side bracket and the main body to form a structure into which a top of a joist can be fit, and the roller rotatably mounted between the side bracket and the main body and rotatable about an axis extending perpendicular to the side face of the main body; and wherein the bottom joist engager further comprises a bottom joist bracket and a joist side weldment secured to the bottom joist bracket to extend substantially parallel to a side face of the main body, the side weldment, the bottom joist bracket, and the main body forming a structure into which a bottom of a joist can be fit.

16. A method of preparing a deck installation platform, comprising:

mounting a first joist runner, having a first flat platform, on a first joist;

mounting a second joist runner, having a second flat platform, on a second joist; and placing a working surface bridged between the first flat platform and the second flat platform;

wherein the first joist runner and the second joist runner each include a joist engager coupled to the flat platform, each joist engager comprising a top joist engagement structure having a top joist engager and a bottom joist engagement structure having a bottom joist engager, for engaging a top and a bottom of the joist therebetween;

and further comprising moving a joist runner of the joist runners on a joist by camming the joist runner to a first angle onto a rotatable roller of its top joist engager for movement of the joist runner along a joist without laterally disengaging the joist.

17. The method of claim 16, wherein the joist runners are arranged to place their flat platforms at an ergonomic working height below a decking surface, for installation of deck boards on the decking surface.

18. The method of claim 16, and further comprising working from the working surface for installation of deck boards on top of the joists of a deck.

19. The method of claim 16, and further comprising disengaging the joist runner from a joist by camming the joist runner to a second angle greater than the first angle, the second angle sufficient to move the top joist engager above a top of the joist.

* * * * *